US006564413B2

(12) United States Patent
Braun et al.

(10) Patent No.: US 6,564,413 B2
(45) Date of Patent: May 20, 2003

(54) METHOD FOR OPERATING A FRONT-LOADING WASHING MACHINE

(75) Inventors: Walter Braun, Schorndorf (DE); Michael Laue, Schorndorf (DE)

(73) Assignee: Whirlpool Corporation, Benton Harbor, MI (US)

( * ) Notice: Subject to any disclaimer, the term of this patent is extended or adjusted under 35 U.S.C. 154(b) by 4 days.

(21) Appl. No.: 10/044,582

(22) Filed: Nov. 9, 2001

(65) Prior Publication Data

US 2002/0108185 A1 Aug. 15, 2002

(30) Foreign Application Priority Data

Nov. 15, 2000 (DE) ..... 100 56 574

(51) Int. Cl.[7] ..... D06F 33/02

(52) U.S. Cl. ..... 8/159; 68/12.04; 68/12.06; 68/12.12

(58) Field of Search ..... 8/158, 159; 68/12.04, 68/12.06, 12.12, 12.14

(56) References Cited

U.S. PATENT DOCUMENTS 5,233,847 A * 8/1993 Tanaka ..... 68/12.04
6,029,300 A * 2/2000 Kawaguchi et al. ..... 8/159
6,158,072 A * 12/2000 Baek et al. ..... 8/159

* cited by examiner

*Primary Examiner*—Philip Coe
(74) *Attorney, Agent, or Firm*—Thomas J. Roth; Robert O. Rice; Stephen Krefman

(57) ABSTRACT

The invention concerns a method for operating a front-loading washing machine with a washing aggregate comprising a tub holding a rotatably-mounted drum suspended in the machine housing so as to be able to oscillate with a midaxis descending from front to back and equipped an imbalance sensor that changes the rotation of the drum by means of a control program when an imbalance occurs in the spin cycle. In many cases of operation an improved spin result can be achieved for a small loads of cotton laundry and the related laundry absorbency by disabling the imbalance sensor and running the spin cycle at the programmed maximum speed.

8 Claims, 1 Drawing Sheet x°/. : 25°/. to 35°/. of C (e.g. 3kg of 9kg)
y°/. : 15°/. to 25°/. of C (e.g. 2kg of 9kg)

x%: 25% to 35% of C (e.g. 3kg of 9kg)

y%: 15% to 25% of C (e.g. 2kg of 9kg)

METHOD FOR OPERATING A FRONT-LOADING WASHING MACHINE

BACKGROUND OF THE INVENTION

1. Field of the Invention

The invention concerns a method for operating a front-loading washing machine with a washing aggregate comprising a tub holding a rotatably-mounted drum suspended in the machine housing so as to be able to oscillate with a midaxis descending from front to back and equipped with an imbalance sensor that changes the rotation of the drum by means at a control program when an imbalance occurs in the spin cycle.

2. Description of the Related Art

In a front-loading washing machine of this kind, as a result of the physical laws of gravity and centrifugal force, an asymmetrical imbalance occurs at a specific point precisely when the laundry loads are small. In an inclined washing aggregate the small amount of laundry always travels to the back and the bottom of the drum above all during the spin cycle and collects there at the lowest point. Here at the rear, i.e., in immediate proximity to the drum bearing, the bearing load is, because of the laws of leverage less when imbalances occur than in the case of imbalances in the front loading area of the washing aggregate. Added to this is that during the spin cycle run-up in a washing aggregate that is inclined a small amount of laundry is better distributed along the rear wall of the drum, i.e., the laundry is more advantageously pulled apart. This also has a positive effect on the imbalance behavior; at the least the degree of imbalance is reduced.

SUMMARY OF THE INVENTION

The problem of the invention is to improve spin results by creating a method for operating a front-loading washing machine of the aforementioned kind that can in a simple way make optimal the superior imbalance advantage of conditions arising in small laundry loads.

BRIEF DESCRIPTION OF THE DRAWINGS

The invention will be further explained with reference to the flow chart in FIG. 1.

DESCRIPTION OF THE PREFERRED EMBODIMENT

Figure 1:
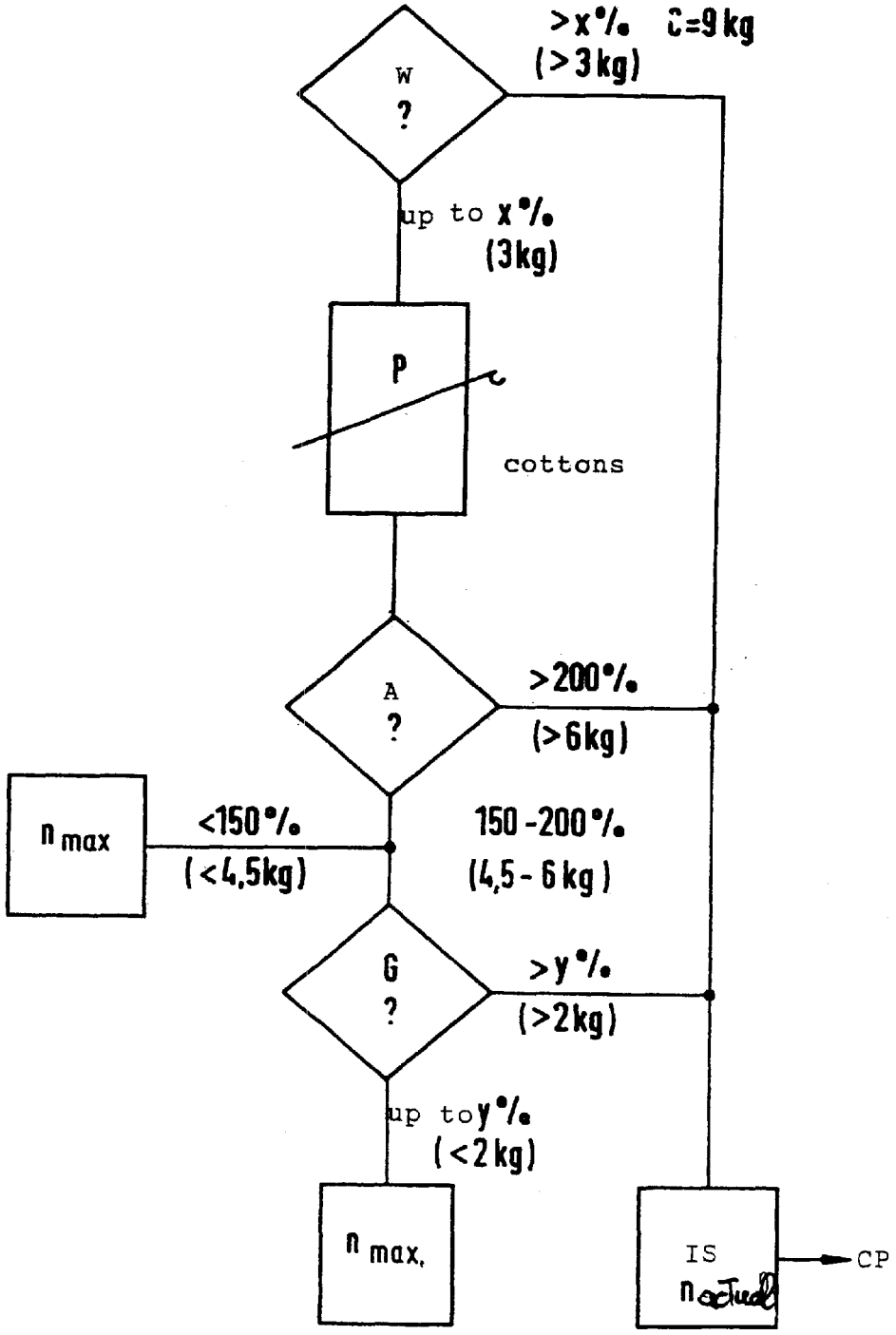

This problem is solved according to the invention in that, when the washing drum is loaded with the laundry type "cottons", the weight and the absorbency of the loaded laundry is determined, and in that up to a preset weight between 25 and 35% of the maximum allowed dry weight and up to an absorbency of less than 150% of the preset weight; the imbalance sensor and its effects on the control program are disabled and the laundry in the drum is spun at the maximum speed.

When the drum is loaded with cottons as the laundry type in small amounts in terms of weight and absorbency, operating ranges can be derived for the spin cycle that can with no input from the imbalance sensor be run at maximum speed without having to fear that the arising imbalance will overload the drum. Thus precisely for cottons as a frequently occurring laundry type a spin result can be achieved as equal to a maximum laundry load with no imbalance.

If a front-loading washing machine has, for example, a maximum allowed capacity of 9 kg of dry laundry weight, then the preset weight of loaded laundry for which the spin cycle can be run at maximum-speed can be between 25 and 35%, i.e. approximately 2 to 3 kg, and the absorbency can then be fixed at less than 150%, i.e. 3 to 4 kg, of this preset weight.

In another embodiment of the method, provision can be made at determined weight above the preset value for the spin cycle to be run by the control program with the imbalance sensor activated without taking into account the absorbency.

When the weight of the loaded laundry is greater than the preset weight of for example, 25%, then in principle the spin cycle can be run with the imbalance sensor activated.

If the laundry has a higher absorbency, then to optimize the spin result provision can be made, on the one hand, up to preset weight and an absorbency of more than 200% of the preset weight for the spin cycle to be run by the control program with the imbalance sensor activated. On the other hand, up to a preset maximum dry weight and an absorbency between 150 and 200%, for the weight of the loaded laundry to again be determined or taken into account, and only when the determined weight is less than the preset weight to run the spin cycle at maximum speed without using the control program. Here the laundry type, "cottons", can be preset, or preferably preselected manually.

Referring to FIG. 1, the cotton laundry loaded into the drum is weighed and the weight W is determined. In addition, the capacity C, i.e. the maximum dry weight of the washing machine, is taken into account.

In the exemplary embodiment a maximum dry weight of 9 kg is assumed. For the determination of the weight W, a value X is preset between 25 and 35% of the capacity C, e.g., 3 kg. If the determined weight is above this value, then the spin program is run with the imbalance sensor IS activated influencing the control program CP.

If the determined weight W is below this preset value, then the absorbency A of the loaded laundry is also taken into account. If this is over 200% (6 kg) of the capacity C, then the spin cycle is run with the imbalance sensor IS activated. When the absorbency A is less than 150% (4.5 kg), the spin cycle is run at maximum speed $n_{max}$. Within the range of >150% to <200% (>4.5 kg, <6 kg), the weight of the loaded laundry is again taken into account, and a reduced preset value y is set between 15 and 25% of the capacity, e.g. 2 kg.

If the weight W is above 2 kg, then the spin cycle runs with the imbalance sensor IS activated, and only when the weight W is less than 2 kg the spin cycle can be run at maximum speed $n_{max}$.

We claim:

1. A method for operating a front-loading washing machine with a washing aggregate consisting of a tub holding a rotatably-mounted drum suspended in the machine housing so as to be able to oscillate with a midaxis descending from front to back and equipped with an imbalance sensor that changes the rotation of the drum by means of a control program when an imbalance occurs in the spin cycle, wherein, when the drum is loaded with the laundry type "cottons", the weight and the absorbency of the loaded laundry is determined, and, up to a preset weight of 25 to 35% of the maximum allowed dry weight and up to an absorbency of less than 150% of the preset weight, the imbalance sensor and its effects on the control program are disabled and the laundry in the drum is spun at the maximum speed.

2. A method according to claim 1, wherein, for a determined weight above the preset value, the spin cycle is run by the control program with the imbalance sensor activated without taking into account the absorbency.

3. A method according to claim 1, wherein, up to a preset weight and an absorbency of more than 200% of the preset weight the spin cycle is run by the control program with imbalance sensor activated.

4. A method according to claim 1, wherein, up to a preset weight of the maximum dry weight and an absorbency of 150 to 200%, the weight of the loaded laundry is again determined or taken into account, and only for a determined weight less than the preset weight, is the spin cycle run at maximum speed without using the control program.

5. A method according to claim 4, wherein, this determined weight is set in a range from 15 to 25% of the maximum dry weight.

6. A method according to claim 5, wherein the type of laundry can be manually preset, or preferably preselected as "cottons".

7. A method for operating a front-loading washing machine with a washing aggregate consisting of a tub holding a rotatably-mounted drum suspended in the machine housing so as to be able to oscillate with a midaxis descending from front to back and equipped with an imbalance sensor that changes the rotation of the drum by means of a control program when an imbalance occurs in the spin cycle, wherein, when the drum is loaded with the laundry type "cottons", the weight and the absorbency of the loaded laundry is determined, and, up to a preset weight of approximately 2 to 3 kg of the maximum allowed dry weight of 9 kg and up to an absorbency of less than 4.5 kg of the preset weight, the imbalance sensor and its effects on the control program are disabled and the laundry in the drum is spun at the maximum speed of $n_{max}$=1,400 rpm.

8. A method according to claim 7, wherein up to a preset weight less than 3 kg of the maximum dry weight and an absorbency greater than 4.5 kg, but less than 6 kg, the weight of the loaded laundry is again determined or taken into account, and only for a determined weight 1 to 2 kg less than the preset weight is the spin cycle run at maximum speed $n_{max}$= 1,400 rpm without using the control program.

* * * * *